US008915387B2

(12) United States Patent
Kheradvar et al.

(10) Patent No.: US 8,915,387 B2
(45) Date of Patent: Dec. 23, 2014

(54) NURSING BOTTLE APPARATUS FOR IMPROVEMENT OF SUCKLING

(75) Inventors: Arash Kheradvar, Blythewood, SC (US); Wilfried Karmaus, Columbia, SC (US)

(73) Assignee: University of South Carolina, Columbia, SC (US)

( * ) Notice: Subject to any disclaimer, the term of this patent is extended or adjusted under 35 U.S.C. 154(b) by 1078 days.

(21) Appl. No.: 12/539,061

(22) Filed: Aug. 11, 2009

(65) Prior Publication Data

US 2010/0038336 A1 Feb. 18, 2010

Related U.S. Application Data

(60) Provisional application No. 61/188,580, filed on Aug. 11, 2008.

(51) Int. Cl.

| | |
|---|---|
| ***B65B 1/04*** | (2006.01) |
| ***A61J 9/04*** | (2006.01) |
| *A61J 9/00* | (2006.01) |

(52) U.S. Cl.

CPC .... *A61J 9/04* (2013.01); *A61J 9/003* (2013.01)
USPC ..... 215/11.5; 215/11.1; 215/11.6; 215/11.2; 215/11.3; 215/11.4

(58) Field of Classification Search

USPC ..... 215/11, 11.1–11.6; 604/74; 222/207
See application file for complete search history.

(56) References Cited

U.S. PATENT DOCUMENTS

| | | | | |
|---|---|---|---|---|
| 2,043,186 | A * | 6/1936 | O'Dette | 215/11.5 |
| 2,066,445 | A * | 1/1937 | Allen | 215/11.5 |
| 3,768,683 | A * | 10/1973 | Van Den Bosch | 215/11.5 |
| 4,010,861 | A * | 3/1977 | Welten | 215/11.5 |
| 4,730,744 | A * | 3/1988 | Vinciguerra | 215/11.5 |
| 4,865,207 | A * | 9/1989 | Joyner et al. | 215/11.5 |
| 4,883,464 | A * | 11/1989 | Morifuki | 604/74 |
| 4,886,494 | A * | 12/1989 | Morifuji | 604/74 |
| 5,078,287 | A * | 1/1992 | Holmes, III | 215/11.1 |
| 5,749,850 | A * | 5/1998 | Williams et al. | 604/74 |
| 6,253,935 | B1 * | 7/2001 | Fletcher | 215/11.1 |
| 6,398,048 | B1 * | 6/2002 | Kevorkian | 215/11.5 |
| 6,979,184 | B2 | 12/2005 | Wu et al. | |
| 8,016,142 | B2 * | 9/2011 | Renz | 215/11.5 |
| 2003/0183596 | A1 * | 10/2003 | Lombardo | 215/11.5 |
| 2008/0173612 | A1 * | 7/2008 | Renz | 215/260 |
| 2008/0243059 | A1 * | 10/2008 | Yamashita et al. | 604/74 |
| 2009/0127220 | A1 * | 5/2009 | Brown et al. | 215/11.5 |
| 2010/0187183 | A1 * | 7/2010 | Nelson et al. | 210/741 |

* cited by examiner

*Primary Examiner* — Fenn Mathew
*Assistant Examiner* — Cynthia Collado
(74) *Attorney, Agent, or Firm* — Dority & Manning, PA

(57) ABSTRACT

In accordance with certain embodiments of the present disclosure, a nursing bottle is provided. The bottle includes a body having a hollow interior and defining an upper opening. The bottle further includes a nipple joined to the body and disposed over the upper opening. The bottle also includes a means for generating negative pressure within a portion of the interior of the body.

10 Claims, 5 Drawing Sheets

NURSING BOTTLE APPARATUS FOR IMPROVEMENT OF SUCKLING

CROSS-REFERENCE TO RELATED APPLICATION

The present application is based on and claims priority to U.S. Provisional Application 61/188,580 having a filing date of Aug. 11, 2008, which is incorporated by reference herein.

BACKGROUND

There is evidence that breastfeeding is protective against asthma in early childhood. Compared to the children who were not breastfed, those who were breastfed for at least 4 months had vital capacities that were larger than those who were not breastfed, after adjusting for birth weight, sex, and current height and weight (0.008). In addition to bioactive factors transferred to the infant in breast milk, another potential explanation for these associations is the mechanical stimulus due to prolonged suckling at the breast that results in improved mechanics of ventilation in breast fed children compared to bottle-fed infants.

Physical exercise training resulting from suckling at the breast, about six times daily on average (for more than four months), may result in increased elasticity and efficiency of the lung parenchyma. This may lead to increases in lung capacity and airflow in breastfed children compared to bottle-fed children. Such differentials in the pressure generated between breastfed and bottle fed infants have been noted by previous researchers, with findings of up to a three-fold higher negative pressure due to breastfeeding. Thus, at least some of the benefits of breastfeeding may he lost when mothers practice "indirect" breastfeeding (i.e. pumping and bottle feeding their infants) compared to direct suckling at the breast. When direct breastfeeding is not possible, the benefit conferred by direct suckling may be (partly) achieved by the use of modified feeding bottles that would mimic natural direct breastfeeding. However, conventional bottle designs seek to increase pressure and remove negative pressure from the bottle to make fluids flow more easily out of a bottle.

Thus, in order to promote normal lung growth and development, an artificial increase of flow "resistance" from infant feeding bottles may prove beneficial. Such bottles are of increasing significance to improve respiratory health, since approximately 75% of the mothers in the United States pump and bottle feed their children, in particular after one month of lactation.

As such, a need exists for devices that better replicate natural direct breastfeeding. Methods relating to such devices would also be desirable.

SUMMARY

In accordance with certain embodiments of the present disclosure, a nursing bottle is provided. The bottle includes a body having a hollow interior and defining an upper opening. The bottle further includes a nipple joined to the body and disposed over the upper opening. The bottle also includes a means for generating negative pressure within a portion of the interior of the body.

In another embodiment of the present disclosure, a nursing bottle is provided. The bottle includes a body having a hollow interior and defining an upper opening. The bottle further includes a nipple joined to the body and disposed over the upper opening. The bottle also includes a piston mechanism at least partially disposed within the interior of the bottle, the piston mechanism configured to generate negative pressure within a portion of the interior of the body.

In still another embodiment of the present disclosure, a nursing bottle is provided. The bottle includes a body having a hollow interior and defining an upper opening. The bottle further includes a nipple joined to the body and disposed over the upper opening. The bottle also includes a diaphragm at least partially disposed within the interior of the bottle, the piston diaphragm configured to generate negative pressure within a portion of the interior of the body.

Other features and aspects of the present disclosure are discussed in greater detail below.

BRIEF DESCRIPTION OF THE DRAWINGS

A full and enabling disclosure, including the best mode thereof, directed to one of ordinary skill in the art, is set forth more particularly in the remainder of the specification, which makes reference to the appended figures in which.

Figure 1:
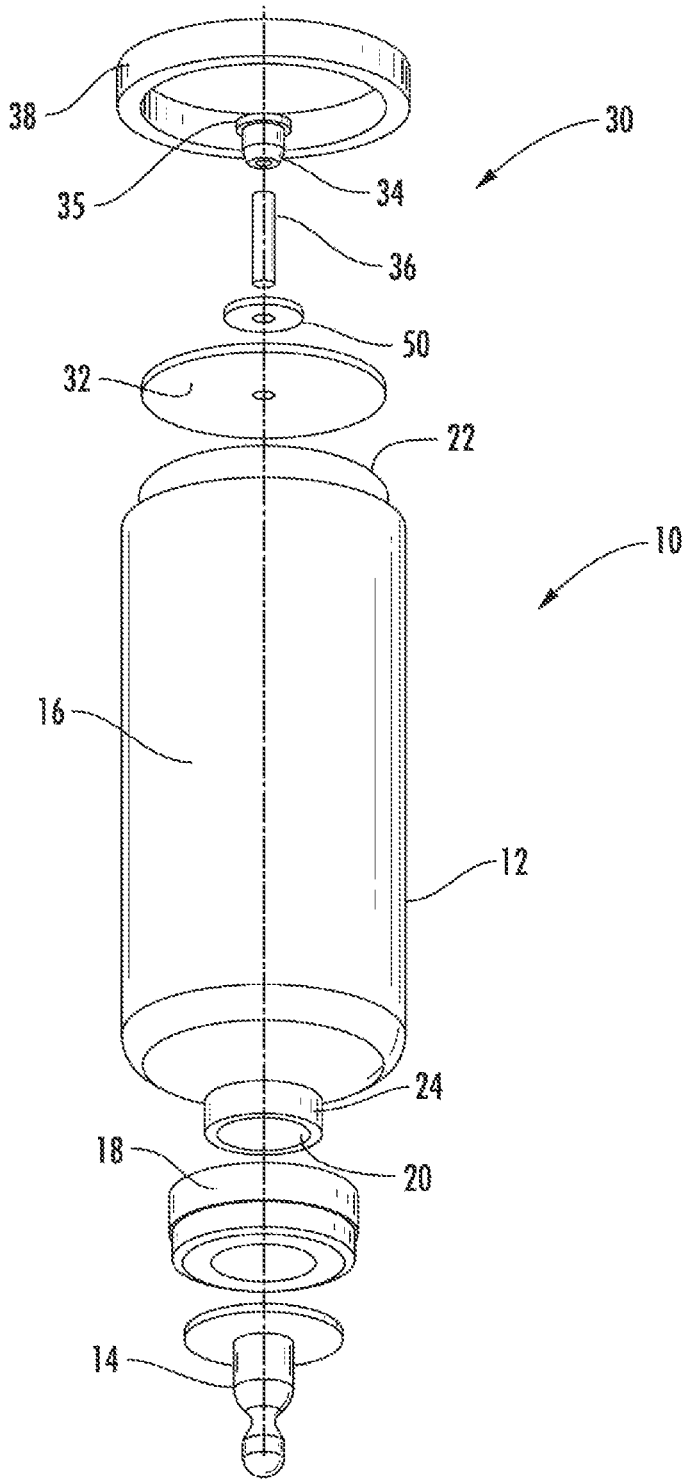
FIG. 1 illustrates an exploded view of a device in accordance with certain embodiments of the present disclosure.
Figure 2A:
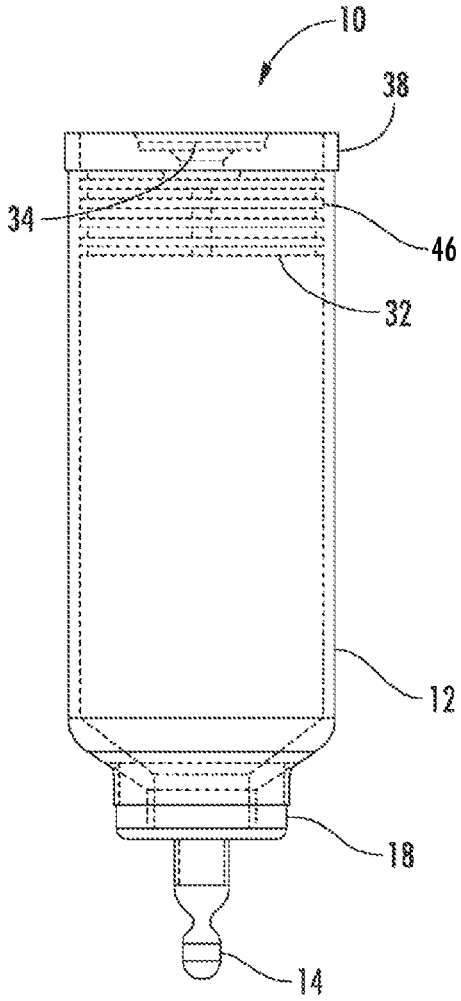
FIGS. 2A-2C illustrates different views of a device in accordance with certain embodiments of the present disclosure.
Figure 2B:
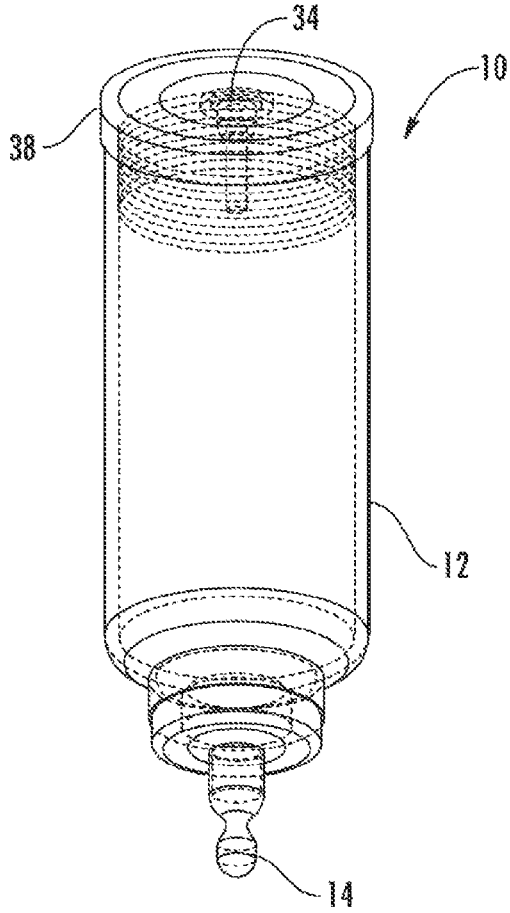
Figure 2C:
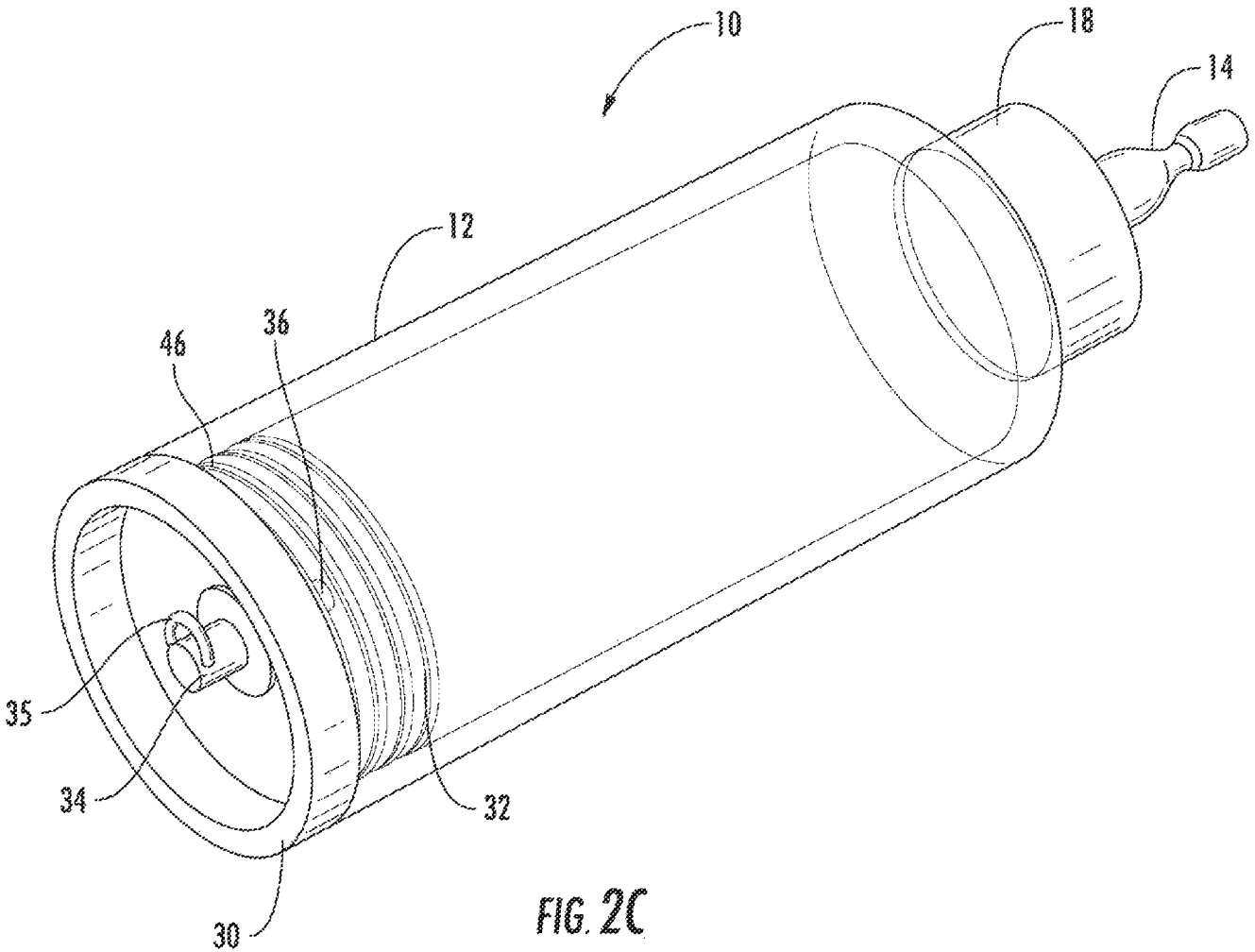

Repeat use of reference characters in the present specification and drawings is intended to represent the same or analogous features or elements of the present disclosure.

DETAILED DESCRIPTION

Reference now will be made in detail to various embodiments of the disclosure, one or more examples of which are set forth below. Each example is provided by way of explanation of the disclosure, not limitation of the disclosure. In fact, it will be apparent to those skilled in the art that various modifications and variations can be made in the present disclosure without departing from the scope or spirit of the disclosure. For instance, features illustrated or described as part of one embodiment, can be used on another embodiment to yield a still further embodiment. Thus, it is intended that the present disclosure covers such modifications and variations as come within the scope of the appended claims and their equivalents.

The present disclosure is generally directed to a nursing bottle. In accordance with the present disclosure, the nursing bottle described herein is designed to improve suckling by providing negative pressure within the bottle during suction. Negative pressure refers to a situation in which an enclosed area has lower pressure than the area around it. Such negative pressure can promote normal lung growth and development with an artificial increase of flow "resistance" within the bottles described herein.

Referring to FIGS. 1 and 2A-2C, a bottle 10 in accordance with the present disclosure is illustrated. FIG. 1 illustrates an exploded view of such bottle 10 including a mechanism for creation of negative pressure therein. Bottle 10 can comprise a substantially rigid body 12 having a nipple 14 disposed at a first open end 20 of the body. Nipple 14 can be in fluid communication with a contained space 16 inside body 12. For example, bottle 10 can comprise a molded bottle with a screw-top opening for attaching a nipple, as would be known in the art. However, any other suitable bottle configuration is contemplated for use with the present disclosure.

Suitable materials for body 12 can include plastic, glass, stainless steel, aluminum, or the like, although any other suitable material may also be used. Similarly, any suitable nipple as would be known in the art can be utilized with bottle 10. Nipple should define a single seal interface from which fluid can pass. However, nipple is designed to remain sealed when not in use so as to maintain negative pressure within contained space 16 of body 12. In addition, nipple can be directly joined to body or can be joined using any suitable method as would be known in the art. For instance, as illustrated, nipple 14 can be joined to body 12 using bottle cap 18. First end 20 of bottle 10 can define threads 24 that correspond to threads within a portion of bottle cap 18. Bottle cap 18 can be screwed onto body 12 with nipple 14 disposed therebetween.

Disposed at the second end 22 of body 12 is a mechanism 30 for creation of negative pressure. However, it should be understood that the mechanism for creation of negative pressure can be located at any suitable location in or on bottle 10. In the particular embodiments illustrated in FIGS. 1 and 2A-2C, negative pressure can be created in the bottle 10 by a piston mechanism 30. In the illustrated embodiments, second end 22 of body 12 defines an opening with piston mechanism 30 positioned therein.

Piston mechanism 30 includes piston 32 and handle 34. Piston 32 can be any suitable piston that can be accommodated by body 12 of bottle 10. Piston can be formed from any suitable material that permits a sealing engagement with body 12 of bottle 10, such as a rigid polymer material or the like. In this manner, piston 32 can be pulled to create negative pressure within contained space 16. Alternative, if too much negative pressure has been created, piston 32 can be pushed in to create positive pressure. Contained space can define grooves 46 that correspond to predefined negative pressure within the interior of the body 12. Piston 32 can be maintained at a desired position within the bottle 10 based upon the desired negative pressure. Indicia can be present on the outside of the bottle or any other suitable location that corresponds to the negative pressure at each groove.

Handle 34 can be any suitable handle. For instance, as illustrated, handle 34 is a swivel handle. Swivel 35 is joined to handle 34 and can be pulled by a user permitting handle 34 to be more easily grasped. Piston 32 can be joined to handle 34 by any suitable method as would be known in the art. For instance, as illustrated, piston mechanism 30 includes swivel 35 joined to handle 34 which is joined to piston shaft 36 that is joined to bottle seal 50 which is joined to piston 32. Bottle stand 38 maintains piston mechanism 30 in place on bottle 10. Second end 22 of bottle 10 can define threads 24 that correspond to threads within a portion of bottle stand 38. Bottle stand 38 can be screwed onto body 12 with piston mechanism 30 disposed therebetween. Bottle stand 38 can also permit handle 34 to be concealed within bottle stand 38, if desired. The various components of piston mechanism can be formed from any suitable materials as would be known in the art. Such components can be integrally joined together or can be assembled and joined using adhesives, fasteners, or any other suitable method of joining as would be known in the art.

Figure 3A:
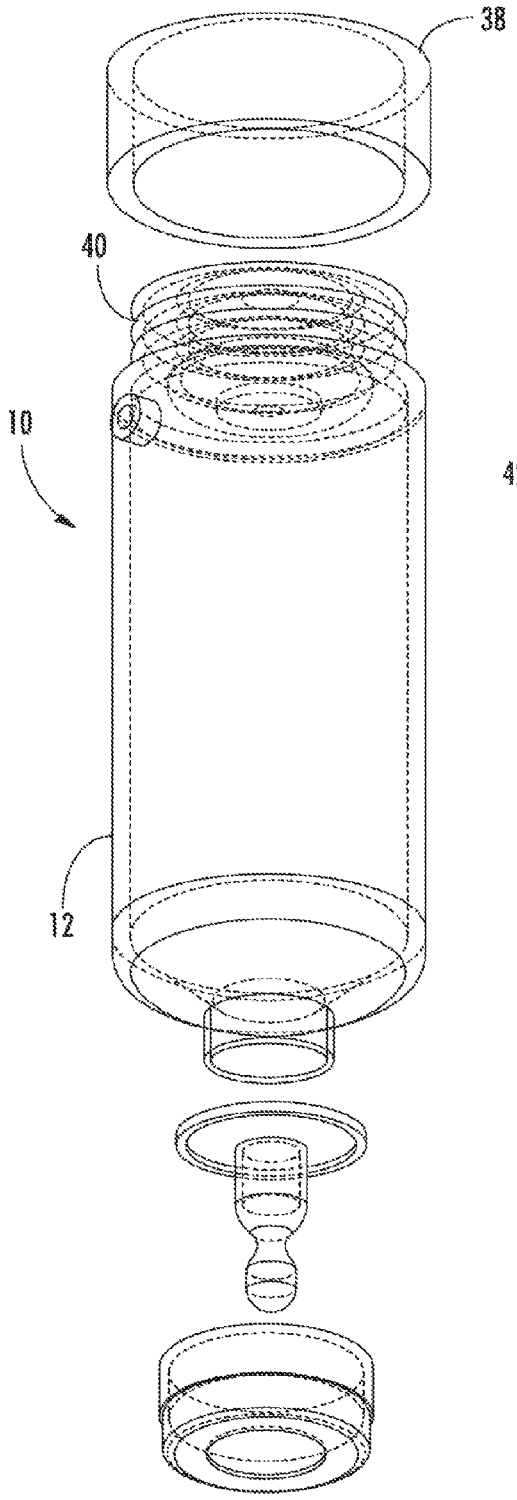
FIGS. 3A-3B illustrate an exploded view of a device in accordance with certain embodiments of the present disclosure.
Figure 3B:
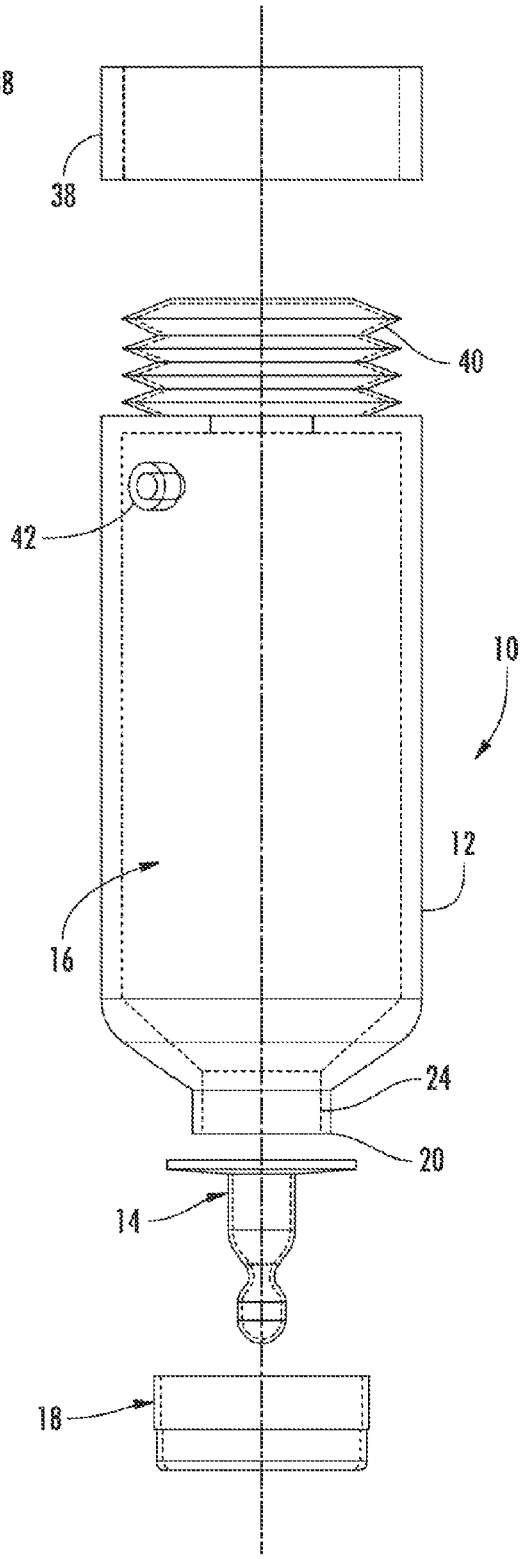
Figure 4:
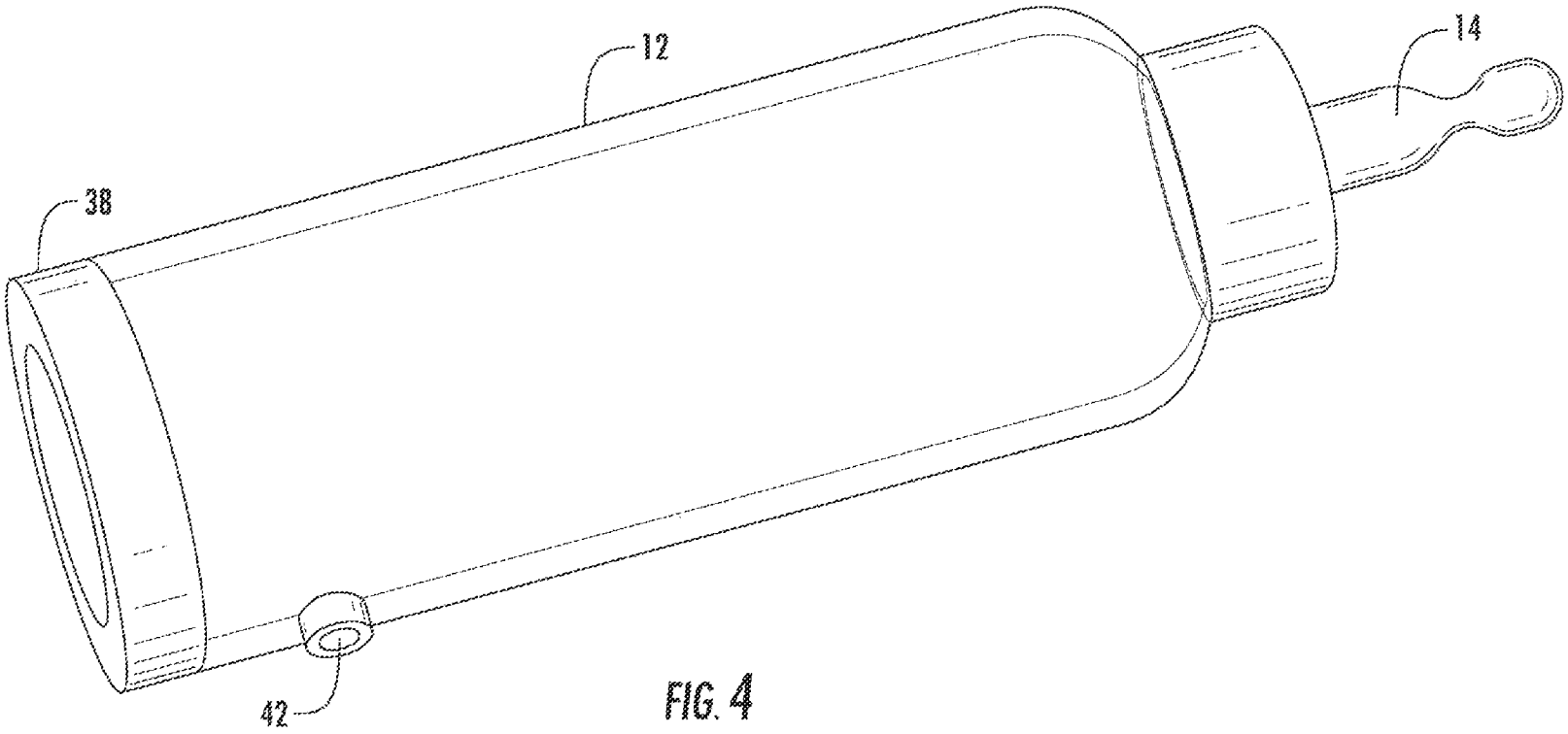
FIG. 4 illustrates a perspective view of a device in accordance with certain embodiments of the present disclosure.

Referring to FIGS. 3A-3B and 4, alternate embodiments of the present disclosure are illustrated. Negative pressure can be created in the bottle 10 by one or more diaphragm 40. In the illustrated embodiments, second end 22 of body 12 defines an opening with diaphragm 40 positioned therein. However, it should be understood that diaphragm can be positioned in or on any suitable location of bottle 10.

Diaphragm 40 can be formed from any suitable material as would be known in the art. For example, diaphragm can be formed from an elastic polymer material. Diaphragm 40 can be convex-shaped Diaphragm 40 forms a seal with the sides of body 12 so that liquid cannot leak from bottle 10. As illustrated, diaphragm 40 is joined to one-way valve opening 42. One-way valve opening 42 can be located in or on the body 12 of bottle 10 or in any other suitable location. Diaphragm can be joined to body 12 using any suitable method such as adhesive or the like. Bottle stand 38 can be screwed onto body 12 with diaphragm 40 disposed therebetween. Bottle stand 38 can also allow diaphragm 40 to be concealed within bottle stand 38, if desired.

Diaphragm 40 can serve as a pump whereby when pressed, air exits the one-way valve 42 and results in diaphragm becoming compressed. In this manner, diaphragm 40 can be utilized to create negative pressure within contained space 16. Alternative, if too much negative pressure has been created, air can be allowed to enter diaphragm 40 to create positive pressure. In certain embodiments, the bottle can include a pressure gauge (not illustrated) which can be used to achieve desired negative pressure.

In practice, the bottles described herein can be utilized to provide any number of fluids to a child including, but not limited to, milk, juice, or the like. In this regard, methods of utilizing the present bottles can include adding negative pressure to the bottle during feeding and/or creating negative pressure prior to feeding. In addition, as indicated above, if the negative pressure reaches past a desired level, positive pressure can be added to the bottle.

While certain mechanisms have been described for achieving negative pressure in a bottle, it should be understood that any suitable mechanism for creating negative pressure in a bottle can be utilized in accordance with the present disclosure.

These and other modifications and variations to the present disclosure can be practiced by those of ordinary skill in the art, without departing from the spirit and scope of the present disclosure, which is more particularly set forth in the appended claims. In addition, it should be understood that aspects of the various embodiments can be interchanged both in whole or in part. Furthermore, those of ordinary skill in the art will appreciate that the foregoing description is by way of example only, and is not intended to limit the disclosure.

What is claimed is:

1. A nursing bottle comprising:

a body having an exterior surface and a hollow interior having an interior surface defining a space configured to house a liquid, and defining the body further having an upper opening immediately adjacent to the space;

a nipple joined to the body and disposed over the upper opening; and a diaphragm at least partially disposed within the interior of the bottle, the diaphragm configured to generate negative pressure within the interior space defined by the body, the diaphragm being joined to a one-way valve opening on the exterior surface of the body, wherein the diaphragm is configured as a pump such that, when the diaphragm is pressed, air is expelled out of the body through the one-way value so as to generate negative pressure within the body, wherein the diaphragm is configured to seal against an inner surface of the body.

2. The bottle of claim 1, wherein the diaphragm comprises an elastic, convex-shaped diaphragm.

3. The bottle of claim 1, wherein the body comprises a bottle stand, wherein the diaphragm is at least partially disposed within the bottle stand.

4. The bottle of claim 1, wherein the diaphragm has a bellows-type pump configuration.

5. The bottle of claim 1, wherein the body is made of plastic.

6. The bottle of claim 1, wherein the body extends lengthwise between a first end and a second end, the upper opening being defined at the first end, the second end defining a lower opening, wherein the diaphragm extends at least partially though the lower opening.

7. The bottle of claim 6, wherein the exterior surface extends between the first and second ends, the one way valve extending through the exterior surface.

8. A nursing bottle comprising:

a body having an exterior surface and an interior defining a space configured to house a liquid, the body further having an upper opening immediately adjacent to the space;

a nipple joined to the body and disposed over the upper opening; and a piston mechanism at least partially disposed within the interior of the bottle, the piston mechanism configured to generate negative pressure within the interior space defined by the body, wherein the piston mechanism comprises a diaphragm at least partially disposed within the interior of the bottle, the diaphragm being joined to a one-way valve opening on the exterior surface of the bottle and configured to expel air out of the one-way valve opening and generate negative pressure within the body, wherein the piston mechanism further comprises a piston and a handle, the piston being joined to the handle such that the handle is configured to assist in moving the piston to generate negative pressure, wherein the interior of the body defines grooves that are configured to maintain the piston in a predetermined position within the interior of the body.

9. The bottle of claim 8, wherein the grooves correspond to a predefined negative pressure within the interior of the body.

10. The bottle of claim 8, wherein the body comprises a bottle stand, wherein the piston mechanism is at least partially disposed within the bottle stand.

* * * * *